US006237456B1

(12) United States Patent
Baur

(10) Patent No.: US 6,237,456 B1
(45) Date of Patent: May 29, 2001

(54) CUTTING APPARATUS FOR MOVING FOODSTUFF STRAND

(75) Inventor: Wilhelm Baur, Gestratz (DE)

(73) Assignee: Natec Reich, Summer GmbH & Co. KG, Heimenkirch (DE)

( * ) Notice: Subject to any disclaimer, the term of this patent is extended or adjusted under 35 U.S.C. 154(b) by 0 days.

(21) Appl. No.: 09/452,644

(22) Filed: Dec. 1, 1999

(30) Foreign Application Priority Data

Dec. 2, 1998 (DE) ..... 198 55 524

(51) Int. Cl.[7] ..... B26D 1/40; B26D 1/56
(52) U.S. Cl. ..... 83/285; 83/286; 83/328
(58) Field of Search ..... 83/285, 286, 287, 83/328, 345, 371

(56) References Cited

U.S. PATENT DOCUMENTS

| | | | | |
|---|---|---|---|---|
| 3,138,074 | * | 6/1964 | Hartbauer | 83/285 |
| 3,466,961 | * | 9/1969 | Konovalov et al. | 83/328 |
| 3,869,948 | | 3/1975 | Rau | 83/286 |
| 3,875,838 | * | 4/1975 | Reppert | 83/285 |
| 4,646,164 | * | 2/1987 | Pavlov | 83/285 |

FOREIGN PATENT DOCUMENTS

| | | |
|---|---|---|
| 2318970 | 10/1974 | (DE) . |
| 206756 | 2/1984 | (DE) . |
| 3935435 | 5/1991 | (DE) . |

* cited by examiner

*Primary Examiner*—W. Donald Bray
(74) *Attorney, Agent, or Firm*—Herbert Dubno; Andrew Wilford

(57) ABSTRACT

An apparatus for cutting a foodstuff strand into a succession of pieces has a conveyor for continuously displacing the strand in a direction through a cutting station, a vertical guide rail in the station, a blade in the station lying in a vertical plane, and a holder carrying the blade and vertically displaceable along the rail. An actuator braced between the guide rail and the holder is operable to vertically reciprocate the blade. Upper and lower wheels rotatable about respective upper and lower axes generally parallel to the plane and perpendicular to the direction have offset from the respective axes respective upper and lower pivots attached to the mount. A drive/controller connected to the actuator and to the wheels vertically reciprocates the mount and rotates the wheels for cutting through the strand with the blade while moving the blade synchronously in the direction with the strand.

8 Claims, 3 Drawing Sheets

CUTTING APPARATUS FOR MOVING FOODSTUFF STRAND

FIELD OF THE INVENTION

The present invention relates to a cutting apparatus. More particularly this invention concerns such an apparatus used to cut a moving strand, for instance of a foodstuff such as processed cheese, into a succession of pieces.

BACKGROUND OF THE INVENTION

In order to cut a moving strand, for instance formed of it a stack of strips of cheese slices, into a succession of pieces it is often necessary to make the cut on the fly, that is while the workpiece strand is moving. So long as the strand is not too tall, this can be done by a quick chopping action in which the blade cuts through the strand and retracts so quickly that the strand does not move appreciably during the cutting operation. The cut will be essentially perpendicular to the strand, producing a piece which has neatly squared ends. If, If however, the strand is somewhat taller it is impossible to move the blade down through it and then back out fast enough to form a perpendicular cut and not disturb the movement of the strand through the cutting apparatus. At the very least the cut will extend at an acute angle to a perpendicular to the travel direction, the upper and lower ends of the being cut offset by the distance the strand travels between the time the knife enters the top of the strand and the time it cuts through the lower surface of the strand.

Recourse is therefore to a system where the knife moves perpendicular to the strand travel direction on a carriage that itself can move parallel to this direction. The knife is reciprocated vertically and the carriage horizontally in synchronism so that as the knife is cutting through the strand it is moving synchronously with the strand, performing a perfect perpendicular cut.

While such a system is highly effective, the mechanism is fairly complex, in particular with respect to synchronizing the movement of the carriage with that of the knife. This complexity adds to equipment costs and makes the system particularly difficult to clean, something that is a problem with a machine handling foodstuff.

OBJECTS OF THE INVENTION

It is therefore an object of the present invention to provide an improved cutting apparatus for a moving strand.

Another object is the provision of such an improved cutting apparatus for a moving strand which overcomes the above-given disadvantages, that is which forms a perfectly perpendicular cut and that is relatively simple.

SUMMARY OF THE INVENTION

An apparatus for cutting a strand moving continuously in a direction through a cutting station into a succession of pieces has according to the invention a blade in the station lying in a plane substantially perpendicular to the direction, a mount carrying the blade, and a wheel rotatable about an axis generally parallel to the plane and perpendicular to the direction and having offset from the axis a pivot attached to the mount. A controller/drive vertically reciprocates the mount and rotates the wheel for cutting through the strand with the blade while moving the blade synchronously in the direction with the strand. The drive rotates the wheel at such a speed and reciprocates the mount at such a speed that the blade cuts through the strand perpendicular to the direction.

The use of a wheel and a blade mounted eccentrically on it is particularly advantageous in that it is a very simple way to move the blade in the direction synchronously with the strand being cut, so as to form the desired perpendicular cut. The mechanism is quite simple and, when the wheels are rotated by a standard stepping motor it is relatively easy to vary the angular speed of the wheel in dependence on a vertical position of the blade.

According to to a further feature of the invention the mount includes a holder carrying the blade and a vertical guide rail secured to the wheel at the pivot and along which the holder is reciprocal. The drive includes a linear actuator braced between the holder and the guide rail.

For maximum stability a second wheel rotatable about a second axis parallel to and below the axis of the first-mentioned wheel has offset from the axis a second pivot attached to the mount below the pivot of the first wheel. The drive rotates the first and second wheels synchronously. It is of course possible to provide a third and even fourth synchronously rotating wheel for maximum stability.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
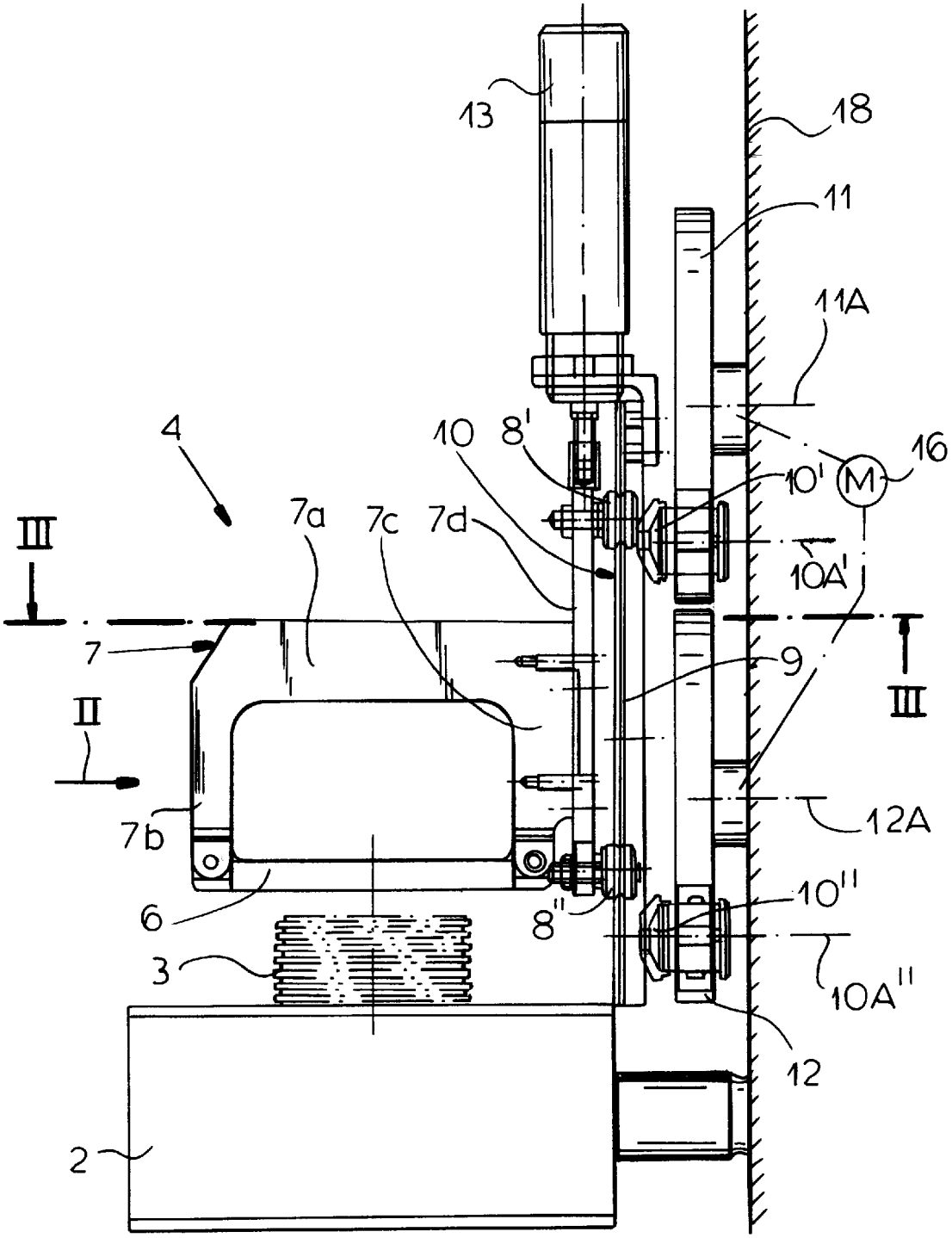
FIG. 1 is a partly diagrammatic vertical cross section through the apparatus according to the invention.
Figure 2:
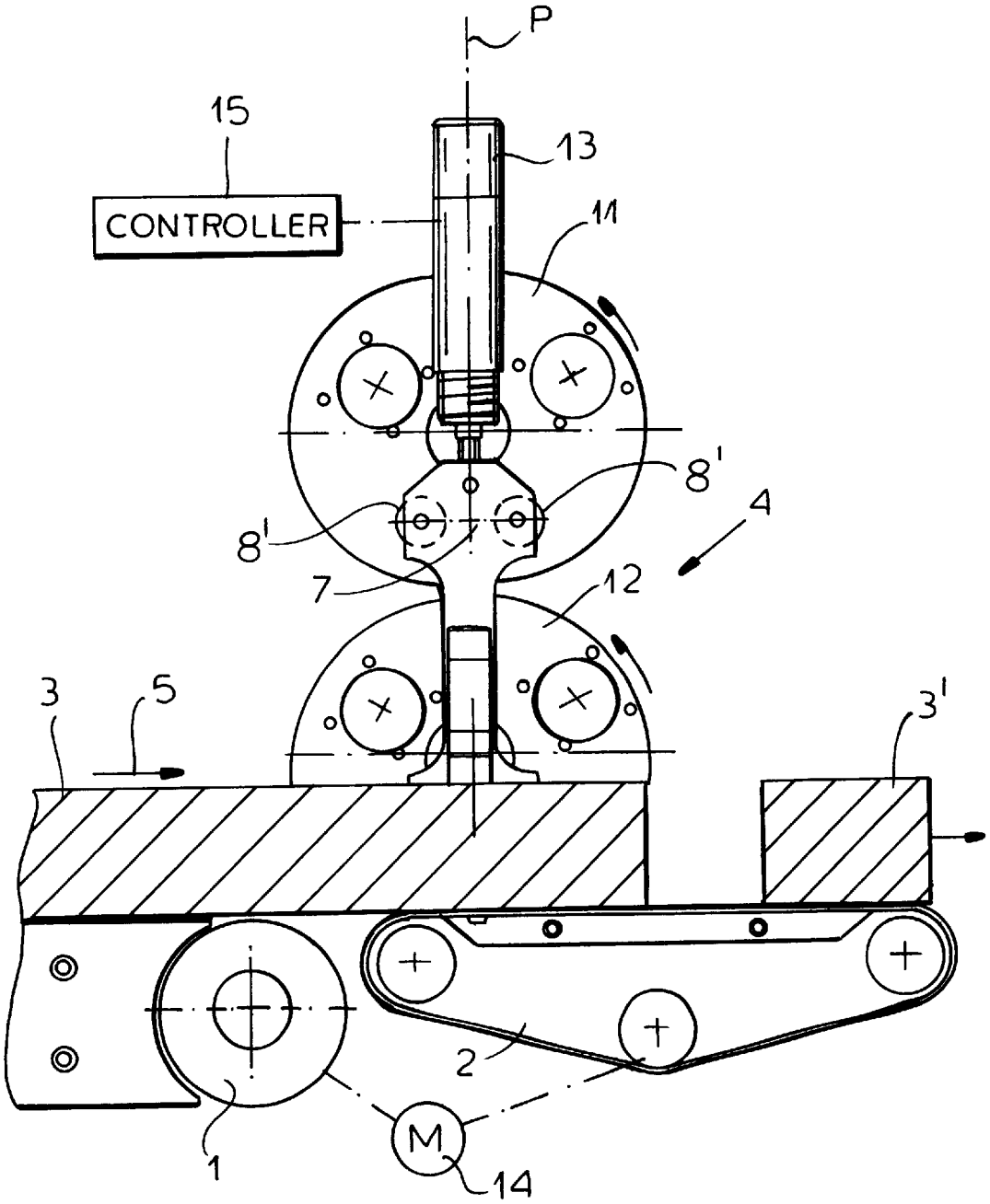
FIG. 2 is a partly diagrammatic side view taken in the direction of arrow II of FIG. 1.
Figure 3:
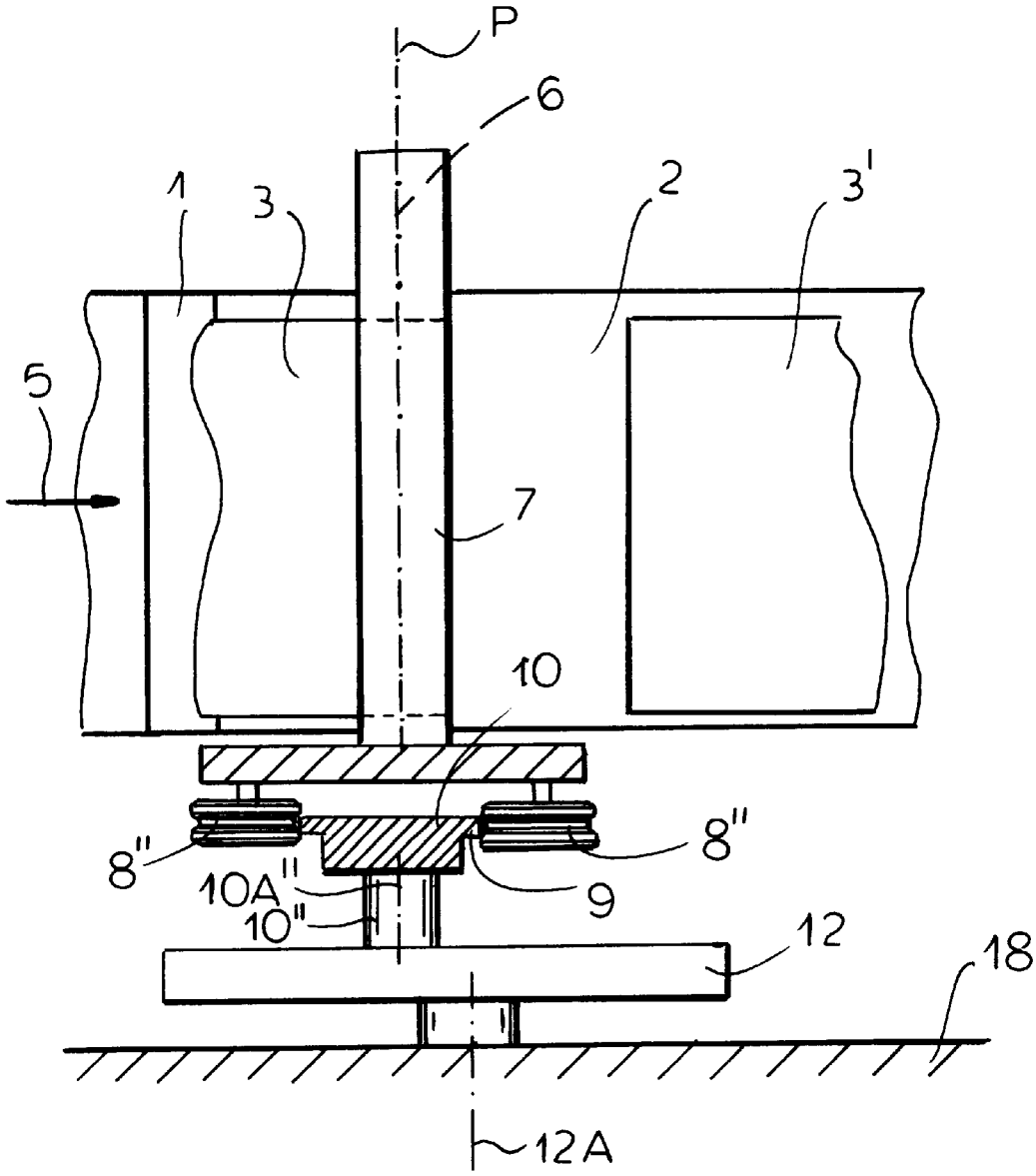
FIG. 3 is a section taken along line III—III of FIG. 1.

As seen in FIGS. 1 and 2, a pair of conveyor belts 1 through 3 operated by a drive 14 in turn operated by a controller 15 move a continuous strand 3 of food, here a stack of cheese strips, through a cutting station 4 continuously in a direction 5 at a constant speed. A knife blade 6 lying in a vertical plane P where in FIG. 2 is carried on a downwardly U-shaped holder 7 having a bight 7*a*, a pair of downwardly extending arms 7*b* and 7*c* between which the blade 6 is removably mounted, and an upright support bar or bracket 7*d*. This bar 7*d* carries a pair of upper rollers 8' and lower rollers 8" that ride on a guide rail 9 formed on a mounting plate 10. A fluid-powered actuator cylinder 13 carried on the plate 10 is connected to the bracket 7*d* to move the blade 6 up and down in a plane parallel to itself and parallel to the rail 9. The controller 15 operates the cylinder 13.

The plate 10 has an upper pivot 10' secured at an axis 10A' on an upper wheel 11 rotatable on a machine frame shown schematically at 18 about an axis 11A and a lower pivot 10" secured at an axis 10A" on a lower wheel 12 rotatable about an axis 12A parallel to and below the axis 11A. The pivots 10' and 10" are offset from the respective axes 11A and 12A. A common motor 16 also operated by the controller 15 rotates the wheels 11 and 12 in the same sense at the same speed so that the pivot axes 10A' and 10A" always lie in a vertical plane.

The controller 15 controls the rotation speed of the wheels 11 and 12 in synchronism with operation of the actuator 13 so that the blade 6 is moving in the direction 5 at the exact same speed as the strand 3 when it is in contact therewith. Thus the cut will be perfectly perpendicular to the direction 5 producing pieces 3' with squared ends.

I claim:

1. An apparatus for cutting a strand moving continuously in a direction through a cutting station into a succession of pieces, the apparatus comprising:

a blade in the station lying in a plane substantially perpendicular to the direction;

a mount carrying the blade;

a wheel rotatable about an axis generally parallel to by the plane and perpendicular to the direction and having offset from the axis a pivot attached to the mount; and drive means for rotating the wheel and thereby vertically reciprocating the mount so as to cut through the strand with the blade while moving the blade synchronously in the direction with the strand.

2. The strand-cutting apparatus defined in claim 1 wherein the drive means rotates the wheel at such a speed and reciprocates the mount at such a speed that the blade cuts through the strand perpendicular to the direction.

3. The strand-cutting apparatus defined in claim 1 wherein the drive means rotates the wheel at an angular speed varied in dependence on a vertical position of the blade.

4. The strand-cutting apparatus defined in claim 1 wherein the mount includes a holder carrying the blade and a vertical guide rail secured to the wheel at the pivot and along which the holder is reciprocal.

5. The strand-cutting apparatus defined in claim 4 wherein the drive means includes a linear actuator braced between the holder and the guide rail.

6. The strand-cutting apparatus defined in claim 1 further comprising a second wheel rotatable about a second axis parallel to and below the axis of the first-mentioned wheel and having offset from the second axis a second pivot attached to the mount below the pivot of the first wheel, the drive means rotating the first and second wheels synchronously.

7. The strand-cutting apparatus defined in claim 1, further comprising transport means for continuously displacing the strand through the station at a constant speed.

8. An apparatus for cutting a foodstuff strand into a succession of pieces, the apparatus comprising:

conveyor means for continuously displacing the strand in a direction through a cutting station;

a vertical guide rail in the station;

a blade in the station lying in a vertical plane;

a holder carrying the blade and vertically displaceable along the rail;

an actuator braced between the guide rail and the holder and operable to vertically reciprocate the blade;

upper and lower wheels rotatable about respective upper and lower axes generally parallel to the plane and perpendicular to the direction and having offset from the respective axes respective upper and lower pivots attached to the mount; and drive means connected to the actuator and to the wheels for rotating the wheels and thereby vertically reciprocating the mount for cutting through the strand with the blade while moving the blade synchronously in the direction with the strand.

* * * * *